US006527608B2

(12) United States Patent
Calco

(10) Patent No.: US 6,527,608 B2
(45) Date of Patent: Mar. 4, 2003

(54) THROWING DISC WITH CHANGEABLE AERODYNAMIC CHARACTERISTICS

(76) Inventor: Wayne A. Calco, 392 Hope St., No. 4, Mountain View, CA (US) 94041

( * ) Notice: Subject to any disclaimer, the term of this patent is extended or adjusted under 35 U.S.C. 154(b) by 0 days.

(21) Appl. No.: 09/912,906

(22) Filed: Jul. 25, 2001

(65) Prior Publication Data

US 2003/0022587 A1 Jan. 30, 2003

(51) Int. Cl.[7] ..... A63H 27/00

(52) U.S. Cl. ..... 446/48; 446/46; 446/34; 473/588

(58) Field of Search ..... 446/34, 46, 48, 446/47, 236, 243, 265, 255; 473/588, 589

(56) References Cited

U.S. PATENT DOCUMENTS 2,425,966 A * 8/1947 Tjomsland ..... 473/588
4,080,753 A * 3/1978 Hiner et al. ..... 446/47
4,176,843 A * 12/1979 DeWitt, Jr. ..... 40/324
4,207,702 A * 6/1980 Boatman et al. ..... 446/219
4,351,129 A * 9/1982 Kerkenbush et al. ..... 446/46
4,466,212 A * 8/1984 Lehman ..... 446/46
4,503,635 A * 3/1985 Harrington ..... 446/46
4,940,441 A * 7/1990 Novinsky ..... 446/46
5,288,256 A * 2/1994 Lee et al. ..... 446/48
5,393,256 A * 2/1995 Mitchell et al. ..... 446/15
5,480,334 A * 1/1996 Wilson et al. ..... 446/46
5,674,102 A * 10/1997 Lin ..... 446/46
5,882,239 A * 3/1999 Trichak ..... 446/219

* cited by examiner

*Primary Examiner*—Derris H. Banks
*Assistant Examiner*—Bena B. Miller
(74) *Attorney, Agent, or Firm*—Dorsey & Whitney LLP

(57) ABSTRACT

A throwing disc with changeable aerodynamic characteristics for use with human hands having fingers, comprising a first member which is circular and has a diameter and a thickness substantially less than the diameter of the first member. The first member has first and second surfaces and has an outer margin and a downward depending lip adjoining the outer margin. A second member is centrally disposed with respect to the first member. The first and second members are interconnected so the first and second members can move in unison as the throwing disc is thrown. The second member is movable with respect to the first member for changing the aerodynamic characteristics of the throwing disc.

14 Claims, 2 Drawing Sheets

THROWING DISC WITH CHANGEABLE AERODYNAMIC CHARACTERISTICS

This invention relates to a throwing disc with changeable aerodynamic characteristics.

Various types of throwing discs have heretofore been provided, often commonly designated as "Frisbees". Certain of these devices have been provided with holes allowing air to pass through. These holes are principally an ornamental feature. Even though such holes may affect the aerodynamic characteristics of the disc, such a disc has only a single aerodynamic characteristic. There also are discs which have been provided which have greater or lesser lifting characteristics and discs which are high performance with little lift. There is, however, a need for a single disc in which many of these different types of characteristics can be obtained.

In general, it is an object of the present invention to provide a throwing disc with changeable aerodynamic characteristics which makes it possible to change the disc for different performances ranging between high and low performance and for different lifts.

Another object of the invention is to provide a throwing disc of the above character in which changes in performance and lift can be readily made.

Another object of the invention is to provide a throwing disc of the above character which changes in performance and lift can be made with ease.

Another object of the invention is to provide a throwing disc of the above character which can be economically manufactured.

Additional objects and features of the invention will appear from the following description in which the preferred embodiment is set forth in detail in conjunction with the accompanying drawings.

In general, the throwing disc with changeable aerodynamic characteristics is for use with the human hands having fingers and comprises a first member which is circular and has a diameter and a thickness substantially less than the diameter of the first member, the first member having first and second surfaces and having an outer margin and a downwardly extending lip adjoining the outer margin, a second member centrally with respect to the first member. Means is provided for interconnecting the first and second members so that the first and second members can move in unison. The second member is movable with respect to the first member for changing the aerodynamic characteristics of the throwing disc.

Figure 1:
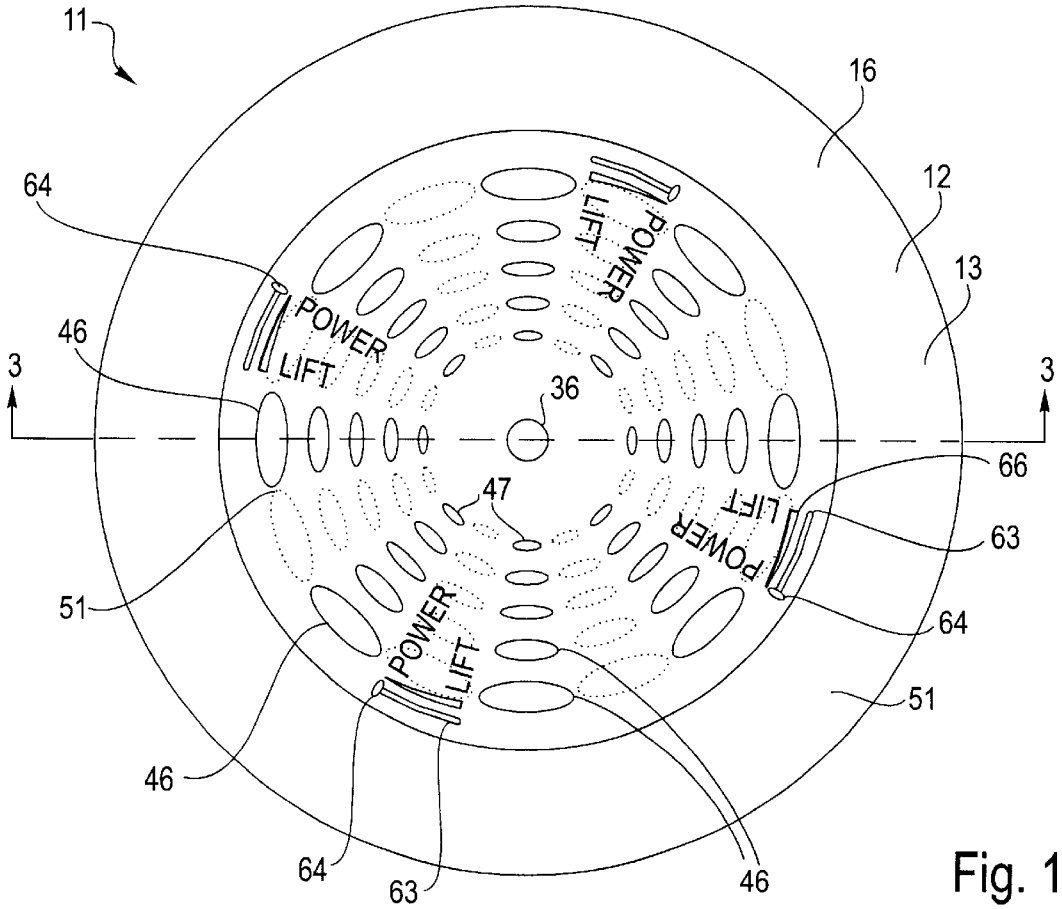
FIG. 1 is a top plan view of a throwing disc with changeable aerodynamic characteristics incorporating the present invention and showing the throwing disc in an adjusted power position and in dotted lines an adjusted lift position.
Figure 2:
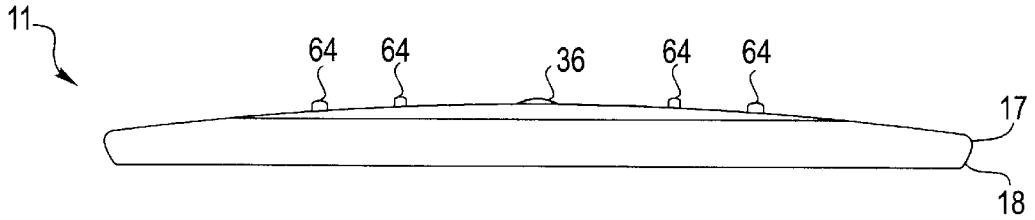
FIG. 2 is a side elevational view of the throwing disc shown in FIG. 1.
Figure 3:
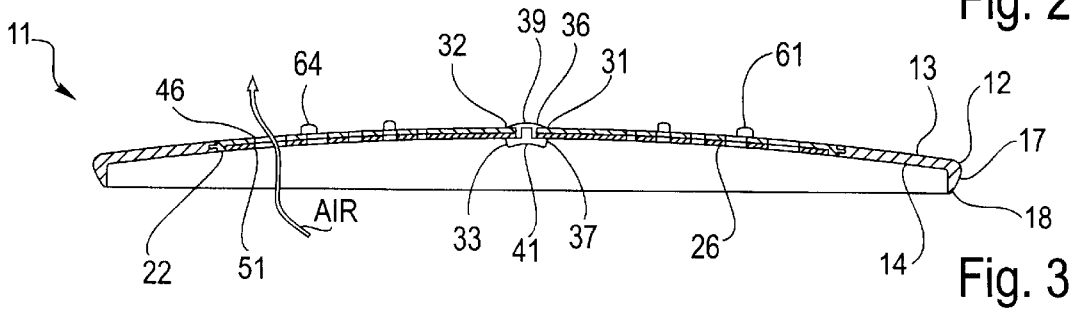
FIG. 3 is a cross sectional view taken along the line 3—3 of FIG. 1.

More particularly as shown in FIGS. 1, 2 and 3 of the drawings, the throwing disc or device 11 with changeable aerodynamic characteristics is for use with human hands having fingers and is comprised of a first member 12 which is circular and has the form of a circular disc. The disc is formed of a suitable sheet-like material such as plastic and has a suitable diameter such as approximately 10" and has a thickness which is substantially less than the diameter as for example ⅛". The first member 12 is provided with a first or top surface 13 and a second or bottom surface 14. As shown, the first surface 13 is generally convex whereas the second or bottom surface 14 is generally concave. The first member 12 is provided with an outer margin 16 and is provided with a downwardly depending lip 17 which gradually decreases in thickness in a downward direction and terminates in a rounded annular surface 18.

A second member 21 is disposed in a juxtaposed position with respect to one of the first and second surfaces 13 and 14 of the first member 12. Thus as shown, the second member 21 also can be circular in form and in the form of a circular disc. It also has a suitable diameter such as 7" with the thickness of the member 21 being substantially less than the diameter as for example 1/16". In order to further enhance the aerodynamic characteristics of the throwing disc, the second member 21 is disposed in a circular recess 22 of a suitable depth such as 1/16" extending through the second or bottom surface 14 of the first member 12. The depth of the circular recess 22 corresponds to the thickness of the second member 21 so that the lower surface 26 of the second member is flush with the bottom surface 14 of the first member 12. However, it should be appreciated that in accordance with the present invention it is possible to provide the second member 21 so that it is not recessed and merely lies adjacent the surface 14 or alternatively can be positioned on top so it lies adjacent the surface 13. The second member 21 is provided with a curvature which corresponds to the curvature of the first member 12 and therefore has a convex upper surface 24 and a concave lower surface 26.

Means is provided for interconnecting the first and second members 12 and 21 so that the first and second members 12 and 21 can move in unison when the throwing disc is thrown. This means in the embodiment shown in FIGS. 1–3 permits relative sliding movement between the first and second members 12 and 21. Thus there has been provided a centrally disposed pin 31 which extends through holes 32 and 33 provided respectively in the first member 12 and the second member 21 to permit rotational sliding movement of the first and second members 12 and 21 with respect to each other. The pin 31 is provided with a cap 36 which overlies the top surface 13. An ergonomic finger spinner 37 is provided which is mounted on the underside or concave lower surface 26 and is provided with a protrusion 38 which extends into a cylindrical hole 39 provided in the pin 31 and is bonded thereto so that the pin 31 and the spinner 37 interconnect the first and second members 12 and 21 while permitting rotational translational movement of the first and second members 12 and 21 with respect to each other. The spinner 37 is provided with a concave recess 41 which is adapted to receive a finger of a hand which can be utilized for spinning the throwing disc 11 in a manner well known to those skilled in the art.

At least one hole or vent and preferably a plurality of holes or vents 46 are provided in the first member 12 and are arranged in sizes and positions in a predetermined pattern in the first member. Thus by way of example as shown in FIG. 1, the holes can be of any desired shape as for example the oval shape shown with the holes 46 being arranged in a plurality of radially extending sets of holes which are spaced apart circumferentially in rows 47 in which the holes 46 increase in size progressively in a direction extending away from the center pin 31 toward the outer margin 16 of the first member 12. It should be appreciated that even though oval-shaped holes 46 have been provided, other types of holes as for example circular or even square holes can be utilized if desired.

Holes or vents 51 are also provided in the second member 21 and preferably are of the same shape and same pattern. Thus they are similarly provided in radially extending sets of holes 51 which are spaced apart circumferentially in rows 52 in which the holes 51 increase in size from the center pin 31 toward the outer margin. Since the holes 51 are arranged in the same pattern as the holes 46 when the second member 21 is slid with respect to the first member 12 by rotational sliding movement, the holes 46 and 51 are moved from a "power" position in which they are in complete registration with each other as shown in FIGS. 1 and 3 to a "left" position as shown in dotted lines where they are completely out of registration with each other and adjusted positions therebetween to provide the adjustable aerodynamic characteristics as hereinafter described and desired with respect to the throwing disc 11 of the present invention.

Adjustment means in the form of a slide control 61 is provided as a part of the throwing disc and is adapted to be engaged by the one or more fingers of a human hand for adjusting or changing the relative slidable positions of the first and second members 12 and 21 with respect to each other. This slide control consists of a pin-and-slot connection in which at least one pin 62 and preferably a plurality of circumferentially spaced apart pins 62 are provided which are formed onto the second member 21 and extend through at least one slot and preferably a plurality of slots 63 formed in the first member 12 and extending through the first member 12. Thus as shown, a plurality of four pins 62 spaced 90° apart are provided and similarly four arcuate slots 63 are provided with the lengths of the slots corresponding to the circumferential length of the holes on the outer margin of the second member 21. Thus as shown, the slots 63 are provided between the largest or outermost holes 46 and 51 of the rows 47 and 52. The uppermost extremity of the pins 62 are provided with oval-shaped knobs 64 adapted to be engaged by a finger of the hand.

At least one directional arrow and preferably a plurality of directional arrows 66 are provided on the top surface 13 of the first member 12 to indicate the direction that the pin 62 must be removed to change the aerodynamic characteristics of the throwing disc from a first or lift position to a second or power position as indicated.

Operation and use of the throwing disc 11 or device may now be briefly described as follows. Let it be assumed that the prospective user is relatively young or is a user who desires maximum lift, the user adjusts or changes the position of the second member 21 relative to the first member 12 by grasping the first member 12 in one hand and then using a finger of the other hand to engage one of the knobs 64 and moving the knob 64 counterclockwise while holding the first member 12 in a stationary position to cause the pins 64 to travel in the arcuate slots 63 to completely close the holes or vents 46 as shown by the offset dotted lines 51 for holes or vents 51. The second member 21 will be retained in the hole or vent-closed position by frictional engagement between the first and second members 12 and 21. After the desired adjustment is made by the user, the throwing device 11 can then be thrown in a conventional manner toward another participant. Because the holes or vents 46 are closed, the throwing disc 11 will provide maximum upward thrust or lifting when thrown as desired by the user.

If the user wishes to make a different adjustment or a new user is more skilled, the lifting aerodynamics can be decreased by again holding the first member 12 in one hand and then grasping a knob 64 with the finger of the other hand and moving the second member 21 with respect to the first member 12 to at least partially open the openings 46 to a fully open position shown in FIGS. 1 and 3 to thereby provide the maximum decrease to the lifting capacity by permitting air flow through the aligned holes 46 and 51 of the disc 11 as indicated by the air flow arrow 81 in FIG. 2 and thereby increasing to a maximum the forward thrust or "power" of the throwing disc as it is thrown. If intermediate lifting capabilities are desired, the knobs 64 are moved to intermediate positions to only partially uncover the openings 46 to provide an intermediate performance throwing disc 11 particularly suitable for less experienced users.

From the foregoing it can be seen that the throwing disc has adjustable aerodynamic characteristics with adjustments from maximum lift to with maximum forward thrust or power with incremental adjustments therebetween to provide the characteristics desired by the user of the throwing disc.

Figure 4:
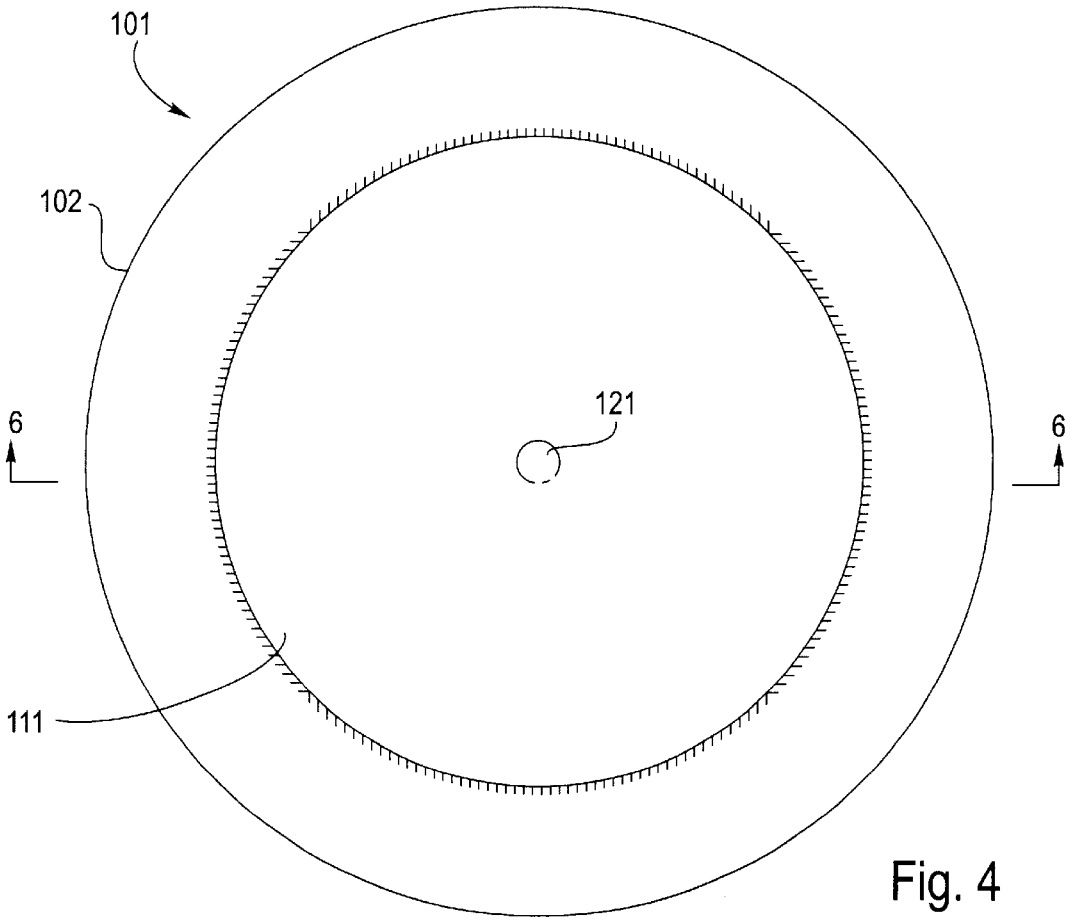
FIG. 4 is a top plan view of another embodiment of a throwing disc incorporating the present invention.
Figure 5:
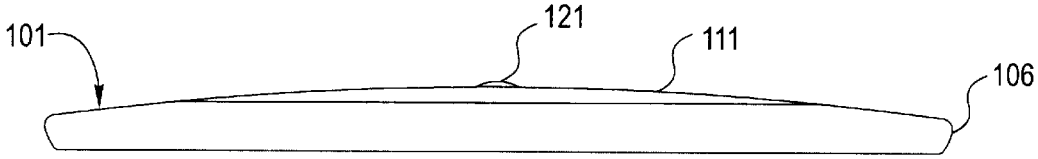
FIG. 5 is a side elevational view of the throwing disc as shown in FIG. 4.
Figure 6:
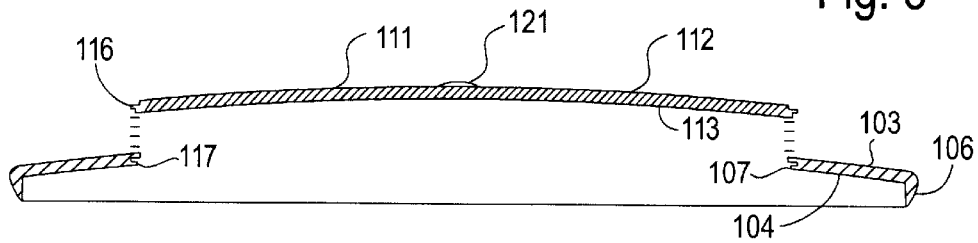
FIG. 6 is a cross sectional view taken along the line 6—6 of FIG. 4.

Another embodiment of a throwing disc incorporating the present invention is shown in the throwing disc 101 in FIGS. 4–6. The throwing disc 101 consists of a first member 102 which in many respects is similar to the first member 12 in the embodiment shown in FIGS. 1–3. It also typically can be formed of plastic and is provided with a first or top surface 103 and a second or bottom surface 104 and is provided with a depending lip 106 much the same as the depending lip 17 in FIGS. 1–3. A large centrally disposed opening 107 is provided in the first member 102 and extends through the surfaces 103 and 104. A second member 111 is provided which is generally circular as shown and is sized so that it can fit within the large opening 107. It has a first or top surface 112 and a second or bottom surface 113. Cooperative mating means is provided for removably securing the second member 111 within the opening 107. As shown, such means can take the form of a tongue-and-groove arrangement in which an annular groove 116 is provided on the outer perimeter of the second member 111 which is adapted to mate with a flexible annular tongue 117 formed as a part of the first member 102. The flexible tongue is adapted to frictionally mate with the groove 116 and to thereby firmly retain the second member 111 within the opening 107 of the first member 102. A cap 121 is provided in the center of the second member 111 of the same type as the cap 36 provided in the embodiment shown in FIGS. 1–3.

Operation and use of the throwing disc 101 shown in FIGS. 4–6 may now be briefly described as follows. Let it also be assumed that the prospective user is relatively young or is a user who desires maximum lift. The user then utilizes the throwing disc with the removable center 111 in place within the central opening 107. The throwing disc can then be utilized as shown to provide a throwing disc having a maximum lift.

Let it now be assumed that the user is more skilled. Such a user would remove the removable second member 111 by snapping it out of the opening 107 by disengaging the interconnecting means in the form of the flexible tongue 117 becoming disengaged from the groove 116 provided for securing the central second member 111 to the first member 102. As soon as this central second member 111 has been removed, the throwing disc 101 is immediately converted to a maximum power throwing disc to obtain distance.

Thus it can be seen that the throwing disc as shown in FIGS. 4–6 is capable of being changed from a throwing disc having maximum lift to one having maximum power. Thus, the throwing disc shown in FIGS. 4–6 has the capability of being changed to either of two capabilities.

The throwing disc in FIGS. 4–6 has the additional advantage that the second member 111 by itself can be utilized as a throwing disc if that be desired. Thus it can be seen that the throwing disc as shown in FIGS. 4–6 has changeable capabilities as does the throwing disc in FIGS. 1–3 with the exception that the throwing disc shown in FIGS. 1–3 can be changed or varied in adjustable or changeable increments.

As can be seen, the throwing disc or devices 11 and 101 of the present invention have been provided with changeable aerodynamic characteristics. Thus it is possible to achieve the characteristics of different types of throwing discs in a single disc. A single disc of the present invention is adapted to fulfill the desires of a number of different types of people as for example young children, children of intermediate age and older children having high throwing skills. The throwing device is of relatively simple construction and can be economically manufactured.

What is claimed:

1. A throwing disc with changeable aerodynamic characteristics for use with the human hands having fingers, comprising a first member which is circular and has a diameter and a thickness substantially less than the diameter of the first member, the first member having first and second surfaces and having an outer margin and a downwardly depending lip adjoining the outer margin, a second member centrally disposed with respect to the first member, means for interconnecting the first and second members so the first and second members can move in unison as the throwing disc is thrown, the second member being movable with respect to the first member for changing the aerodynamic characteristics of the throwing disc, said means provided for interconnecting the first and second members including means for permitting relative sliding movement between the first and second members and at least one opening formed in each of the first and second members so that said at least one opening in each of the said first and second members is movable into and out of registration with each other upon relative sliding movement of the first and second members to thereby change the aerodynamic characteristics of the throwing disc.

2. A throwing disc with changeable aerodynamic characteristics for use with the human hands having fingers, comprising a first member which is circular and has a diameter and has a thickness substantially less than the diameter of the first member, the first member having first and second surfaces and having an outer margin and a downwardly depending lip adjoining the outer margin, a second member disposed in a juxtaposed position with respect to one of the first and second surfaces of the first member, means interconnecting said first and second members to permit relative sliding movement between the first and second members, at least one vent is formed in each of said first and second members, said at least one vent being positioned in the first and second members so that said at least one vent in each of said first and second members are movable into and out of registration with each other upon relative sliding movement of the first and second members to thereby provide a change to the aerodynamic characteristics of the throwing disc.

3. A throwing disc as in claim 2 wherein said first surface of the first member is an upper surface and wherein the second surface of the first member is a lower surface and wherein said second member is disposed on the underside of said first member adjacent said second surface.

4. A throwing disc as in claim 2 further including a slide control adapted to be engaged by a finger of the human hand for causing relative sliding movement between the first and second members from a first or lift position in which the at least one vent in said first and second members are completely out of registration from each other and a first or power position in which the at least one vent are in registration for each other.

5. A throwing disc as in claim 4 wherein said first and second members are movable incrementally between said first and second positions.

6. A throwing disc as in claim 4 wherein said slide control comprises a pin-and-slot connection for permitting limited relative sliding movement of the first and second members with respect to each other.

7. A throwing disc as in claim 6 where the pin and slot connection comprises a slot formed in the first member and a pin carried by the second member and extending into the slot in the first member and being engageable by a finger of the hand on the upper side of the first member.

8. A throwing disc as in claim 7 wherein said means to interconnect said first and second members to permit relative movement between the first and second members includes a centrally disposed pin and wherein said slot has an arcuate configuration with the centrally disposed pin being the center of the arcuate slot.

9. A throwing disc as in claim 8 wherein each of said first and second members is provided with a plurality of vents in each of said first and second members, said vents in said first and second members being movable into and out of registration with respect to each other.

10. A throwing disc as in claim 9 wherein said vents are radially spaced apart with the vents increasing in size with increased distance from the center.

11. A throwing disc as in claim 10 wherein said vents are radially spaced apart in sets and in circumferentially spaced apart rows.

12. A throwing disc as in claim 11 wherein said vents are oval shaped.

13. A throwing disc as in claim 6 further including a plurality of pin-and-slot connections spaced circumferentially apart on the first member.

14. A throwing disc as in claim 4 further including indicia carried by the first or upper surface of the first member and indicating a direction of sliding movement of the slide control for movement between lift and power positions.

* * * * *